US005377933A

United States Patent [19]

Rude et al.

[11] Patent Number: 5,377,933

[45] Date of Patent: Jan. 3, 1995

[54] TAPE SPOOL ASSEMBLY MACHINE

[75] Inventors: Edward T. Rude, Columbia, Md.; Robert L. Mozdzer, Stamford, Conn.

[73] Assignee: General Clutch Corporation, Stamford, Conn.

[21] Appl. No.: 105,442

[22] Filed: Aug. 12, 1993

Related U.S. Application Data

[63] Continuation-in-part of Ser. No. 37,491, Mar. 26, 1993.

[51] Int. Cl.[6] ..... B65H 75/28

[52] U.S. Cl. ..... 242/586.3; 29/243.56

[58] Field of Search ..... 242/68.5, 71.8, 74, 242/74.1, 74.2, 586.3; 81/487; 29/243.56, 278, 281.1

[56] References Cited

U.S. PATENT DOCUMENTS

| | | | |
|---|---|---|---|
| 3,523,654 | 8/1970 | Zielke | 242/74.1 |
| 3,661,345 | 5/1972 | Ritz, Jr. et al. | 242/74.1 X |
| 3,889,894 | 6/1975 | Deguchi | 242/74 |
| 3,944,155 | 3/1976 | Wilczewski et al. | 242/74 |
| 3,973,740 | 8/1976 | Schankier | 242/74 X |
| 4,018,398 | 4/1977 | Louzil | 242/74.1 |
| 4,213,578 | 7/1980 | Katata | 242/74 |
| 4,266,738 | 5/1981 | Nakagawa | 242/71.8 X |
| 4,283,026 | 8/1981 | Werner | 242/74 X |
| 4,901,936 | 2/1990 | Buelens et al. | 242/74.1 |
| 5,060,879 | 10/1991 | Espin | 242/74.1 |

*Primary Examiner*—Daniel P. Stodola
*Assistant Examiner*—John P. Darling
*Attorney, Agent, or Firm*—Gottlieb, Rackman & Reisman

[57] ABSTRACT

There is provided a tape spool retention system having a spool and tape retainer molded of a single plastic part. Assembly of the end of a piece of flat tape is accomplished by inserting the tape into under a pin, molded between the flanges of the spool, and then forcing the pin into an underlying cavity in the core of the spool, thereby wrapping the tape about the pin. The slight interference fit between the pin and the opening of the cavity keeps the assembly together, and when one or two wraps of tape are wound onto the spool, the tape retention is very good. The present invention provides a machine configured to make this assembly operation easy for an unskilled worker to perform reliably. The machine provides a nest for holding the spool. After tape is inserted into the spool, partial operation of the machine's operating lever captures the tape so that is does not move during assembly. Further operation of the operating lever breaks free the pin and forces it into the cavity.

29 Claims, 5 Drawing Sheets

TAPE SPOOL ASSEMBLY MACHINE

This is a continuation-in-part of U.S. patent application Ser. No. 08/037,491, filed on Mar. 26, 1993.

BACKGROUND OF THE INVENTION

Our invention provides a specialized machine for use in the assembly of tape to the spool described in the aforemention U.S. Patent Application, entitled Tape Spool Retention System. The spool of the above patent is unique in that the spool and the tape retainer are molded of one piece. To assemble an end of a piece of tape to the spool it is only necessary to insert the tape between the spool core and the retainer which is positioned just over an opening in the core. Attachment is achieved by forcing the retainer and the tape into the opening. Once seated, the retainer and the tape are held firmly in place by the shape of the opening. The prior art invention greatly simplifies the assembly procedure in that the spool is molded with the retainer correctly positioned for insertion. The space between the flanges of spools can be quite narrow, so that, without the inventive spool, it would be quite difficult to position the tape and a separate retaining piece for assembly.

Several different types of assembly machines may be used for attaching the tape to the spool. Experience has shown that significant improvement in the assembly operation is achieved with the use of our novel assembly machine as compared with the much simpler tool envisaged in the patent application for the Tape Spool Retention System.

BRIEF DESCRIPTION OF THE INVENTION

The newly developed assembly machine of our invention consists of a three functional sub-units. The first sub-unit consists of a fixture for holding the spool in the correct position for assembly. The second sub-unit consists of a mechanism for holding the tape in position for assembly. And the third sub-unit consists of the tool that performs the actual assembly. In the preferred embodiment, the fixture for holding the spool is configured specifically for the spool of the aforementioned patent application, although it will be clear that the fixture could be easily adapted to fit many other spool designs. Both the spool and the fixture have features that allow the spool to be inserted only when correctly oriented, and that retain proper orientation during assembly. The side flanges of the spool provide a lateral guide for the tape, and the apparatus includes a stop to limit the travel of the tape when it has been inserted to the correct depth. A single lever performs the actual assembly operation. The same lever actuates a clamp to hold the tape after it has been inserted into the fixture to assure its correct positioning during assembly. The operating lever also operates the assembly tool which breaks the tape retainer free from the spool flange walls and inserts it to the correct depth in the opening in the spool core.

The preferred embodiment shows a manually operated lever. However, it will be obvious to those skilled in the art of simple machinery that the lever could as well be operated by an air cylinder, a motor, a solenoid, or a mechanical connection to other machinery. It is important the machine not be of excessive length because it will be used at the front of a workbench on which a blind is being assembled. The blind to be assembled must lie on the workbench just beyond the tape-spool assembly machine. If the machine requires too much space along the front of the workbench, then the blind must be positioned farther from the edge of the front edge of the workbench and working on it becomes more difficult. It is also important that the machine be fairly light because, during blind assembly, it must be moved along the length of the blind to attach each tape to its spool.

Accordingly, it is an object of our invention to provide an assembly tool that assembles the end of a length of tape to the core of a spool onto which it will be wound.

It is a further object of our invention to provide a machine that will attach tape to a spool quickly while maintaining accurate alignment of the tape with respect to the spool.

It is yet another object of our invention to provide an assembly machine that will hold the end of the tape in position during assembly to the spool. It is also an object of our invention to provide an assembly machine that will insert the tape retainer to the correct depth in the opening in the core of the spool.

It is still another object of our invention to provide a machine, for attaching tape to a spool, that is light and compact so that it can easily be moved along a workbench as required during the assembly operations.

It is a further objective of our invention to provide a machine, for assembling tape to a spool, that is small in size so that it is easy to move from place to place on a workbench.

Other objects and advantages of our invention will become apparent from the description that follow

BRIEF DESCRIPTION OF THE DRAWINGS

Further understanding of our invention will become apparent upon consideration of the following detailed description in conjunction with the drawings, in which.

DETAILED DESCRIPTION OF THE DRAWINGS

Figure 1:
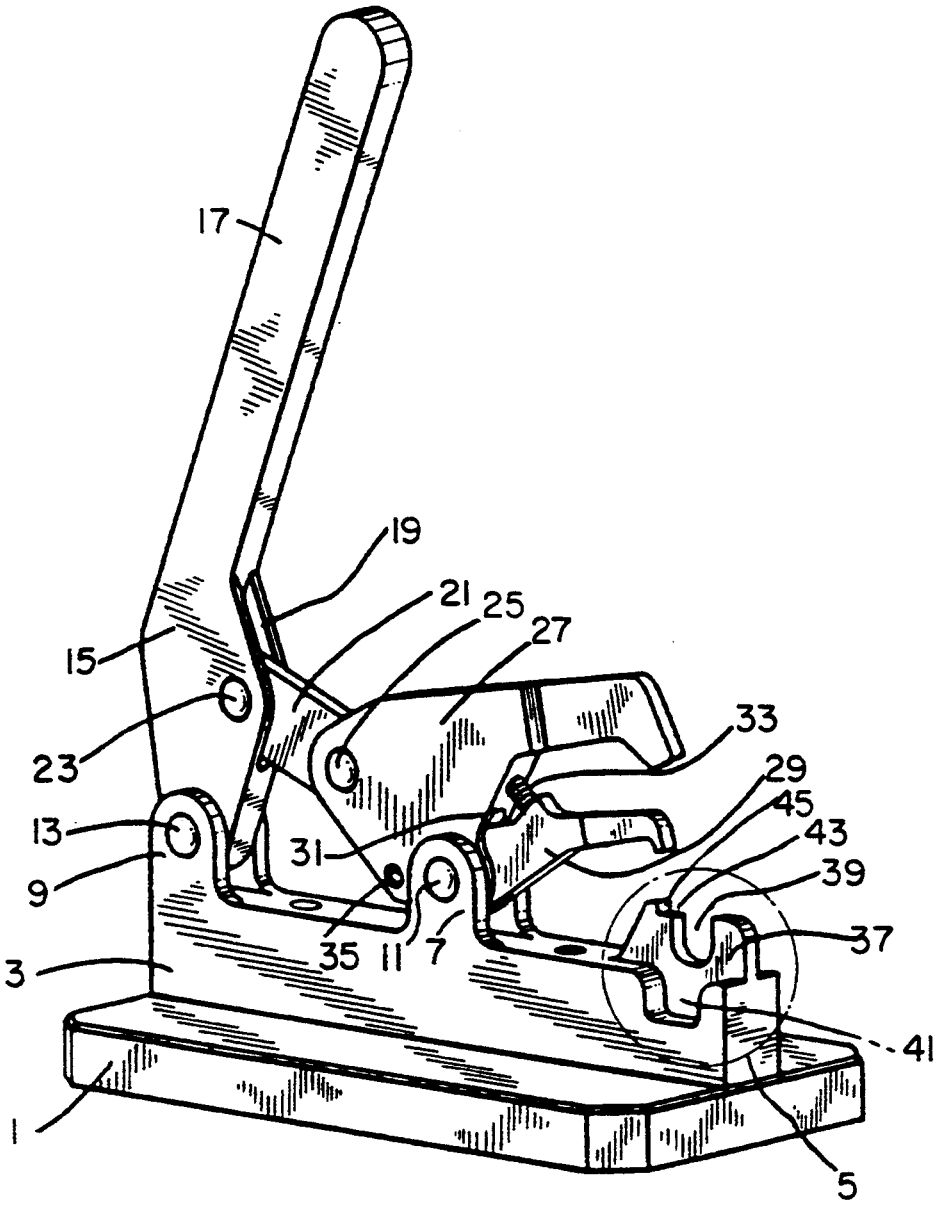
FIG. 1 is a perspective view of the assembly machine of our invention shown in the open position.

Referring now to FIG. 1, the assembly machine of the invention includes mounting plate 1 for providing support. Base 3 is fastened with screws or by any other convenient means to mounting plate 1. Base 3 has a group of features at one end for receiving the spool and holding it in position during assembly. These features are collectively shown as nest area 5, indicated by a dotted circle in FIG. 1. Base 3 also has pairs of flanges 7 and 9 which are formed to act as pillow blocks for tool pivot pin 11 and operating lever pivot pin 13. Operating lever 15 pivots on pivot pin 13 at one end, with the opposite end configured to form hand grip 17. A slot is cut into the edge of operating lever 15 to form clevis 19 for receiving link 21 which is rotatably pinned to operating lever 15 by pivot pin 23. The opposite end of link 21 is rotatably connected by pivot pin 25 to insertion tool 27, again within a clevis slot. Insertion tool or arm 27 has two pin joints. These are the aforementioned clevis pin joint to link 21, and another rotatable pin connection to base 3 via pivot pin 11. This latter joint completes a four bar linkage formed by base 3, operating lever 15, link 21, and insertion tool 27.

Tape clamp 29 fits into cut-out 31 in insertion tool 27. Pivot pin 11 provides for independently rotatable mounting for both insertion tool 27 and tape clamp 29. Compression spring 33 is fitted into holes in insertion tool 27 and tape clamp 29, for urging tape clamp 29 to rotate downwardly. Pin 35 is pressed into holes in the walls of the cut-out portion of insertion tool 27. Downward movement of tape clamp 29 is limited by contact of a stop feature (not shown) on tape clamp 29 with pin 35.

Nest area 5 has features which are specific to the particular spool and tape to be assembled. Insertion tool 27 and tape clamp 29 also have tool portions that are configured specifically for the particular spool and tape in use. It is to be understood that these particular features are merely examples of various combinations of parts that might be assembled with our inventive machine.

More specifically, nest area 5 contains support rib 37 which has a thickness to fit slidably within the side walls of the spool to be assembled. Core cut-out 39 is sized to fit snugly around the core of the spool-to be assembled. Recess 41 in base 3 is configured to receive a positioning tab on the flange of the spools. There is a another recess, symmetrically placed on the opposite side of support rib 37, to accept the symmetrically configured positioning tab on the other flange of the spool. Tape anvil 43 and tape stop 45 of nest area 5 form a right angle at the top inside corner of support rib 37.

Figure 2:
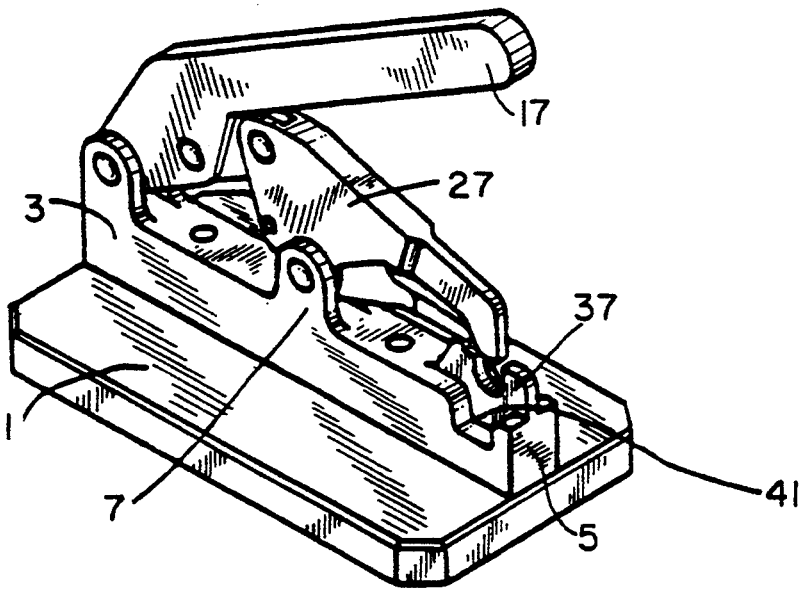
FIG. 2 is a perspective view of the assembly machine of our invention shown in the closed position.

FIG. 2 shows the assembly machine of our invention in the closed position. Hand grip 17 has been rotated forward until it contacts insertion tool 27. In this position, link 21 is fully extended, moving insertion tool 27 as far forward and down as it can go. The four bar linkage of the assembly machine has been carefully configured so that the fully forward position of the insertion tool is correct for the spool to be assembled. In the preferred embodiment, this position has not been left to adjustment, but rather, is predetermined by the design of the linkage. It also be possible to change slightly the configuration of the linkage to permit the insertion tool to travel further, and then limit the travel with a stop which could be adjusted from time to time as necessary. As the insertion tool moves forward and down, tape clamp 29 is also moved forward and down by the pressure of spring 33 until it contacts tape anvil 43.

Figure 3:
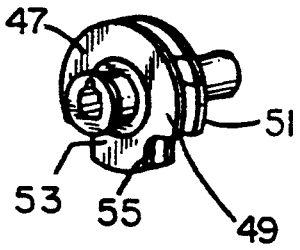
FIG. 3 is a perspective view of a spool assembly as described in U.S. patent application Ser. No. 037,491.

FIG. 3 depicts spool 47, which is a variant of the spool of U.S. patent application Ser. No. 037,491, having been modified by the removal of a portion of each flange to create positioning tabs that correctly orient and maintain the position of the spool in the assembly machine. Spool 47 has two flanges, 49 and 51. Flange 49 has positioning tab 53, and flange 51 has positioning tab 55.

Figure 4:
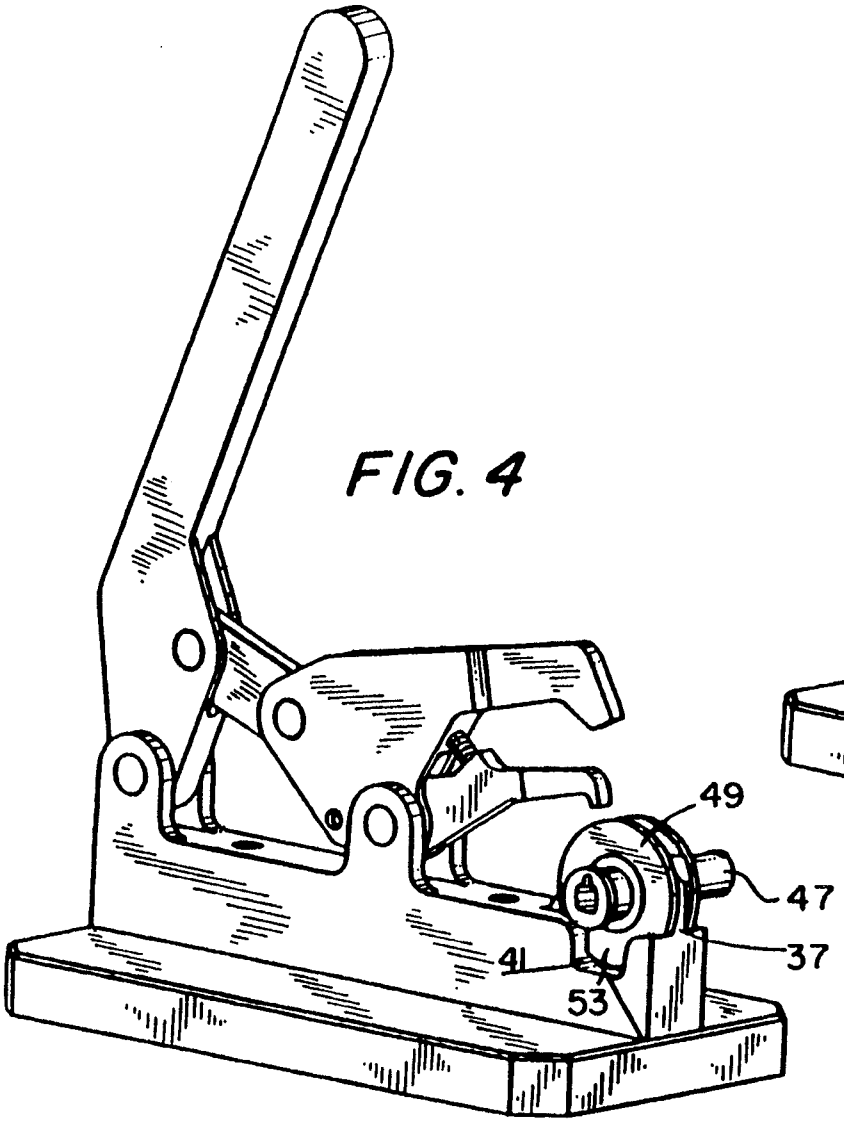
FIG. 4 is the same perspective view as FIG. 1, except that the spool of FIG. 3 is shown mounted onto the machine and in position for assembly.

FIG. 4 shows the assembly machine, again in the open position, with spool 47 loaded into the nest for assembly. The spool has been placed over support rib 37, with positioning tabs 53 and 55 of spool 47 engaging recesses 41 of nest area 5.

Figure 5:
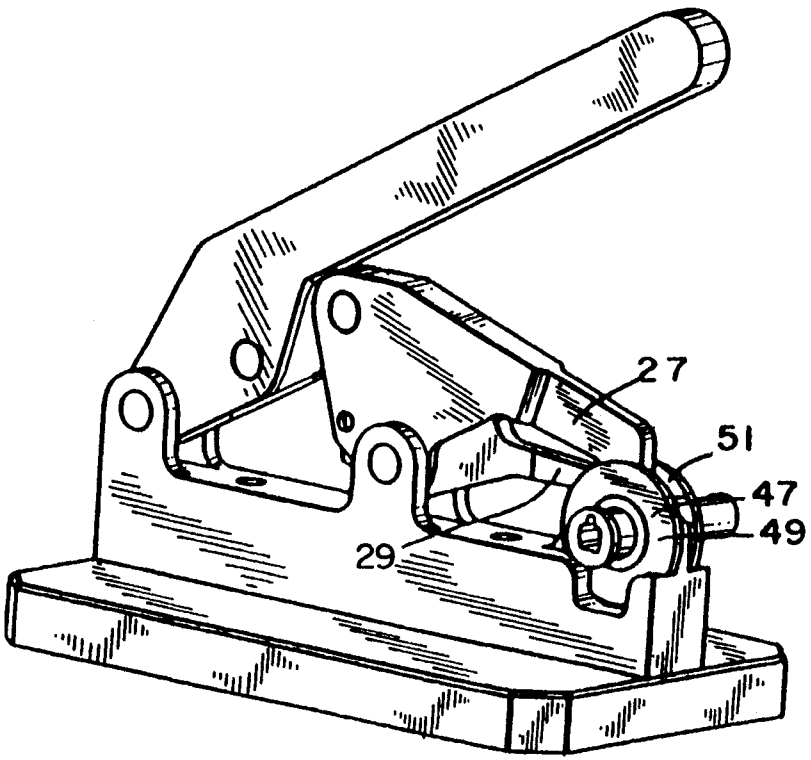
FIG. 5 is a view similar to FIG. 2, but with the spool mounted for assembly.

In FIG. 5, which shows the assembly machine in the fully operated position as in FIG. 2, insertion tool 27 and tape clamp 29 have been moved into their final operating positions between flanges 49 and 51 of spool 47.

The remaining figures, FIGS. 6–9, show four important operating positions of the machine of the invention. Spool 47 has been shown with the near flange, 49, removed so as to show pin 59, core 61, pocket 63, and tape 65 in their respective positions during assembly.

Figure 6:
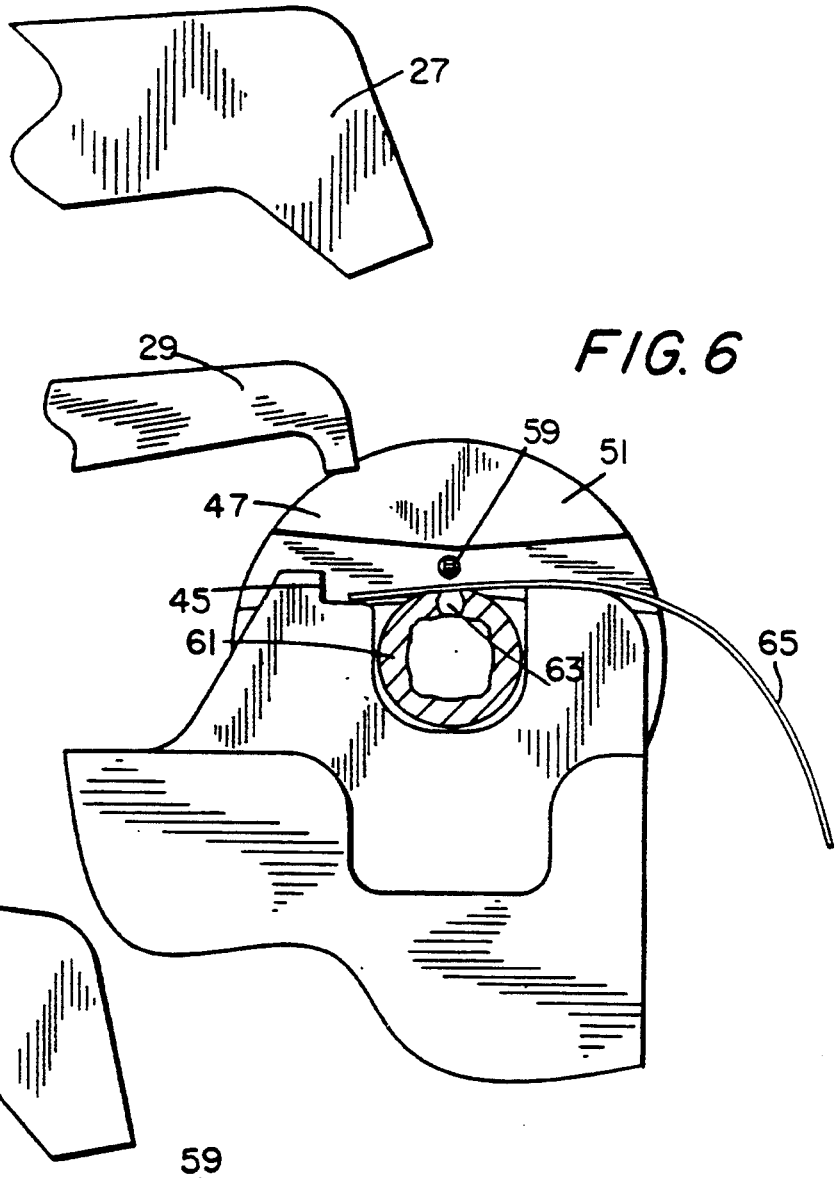
FIG. 6 is a side view of the nest area of the assembly machine including the working ends of the insertion tool, the tape clamp, the end of a piece of tape, and the spool with one flange removed to reveal the core, pocket, and pin.

In FIG. 6, the machine is in the fully open position with insertion tool insertion tool 27 and tape clamp 29 fully retracted. Spool 47 has been placed over support rib 37 for assembly. Tape 65 has been inserted laterally between flanges 49 and 51, and over core 61 and below pin 59, until it comes into contact with tape stop 45.

Figure 7:
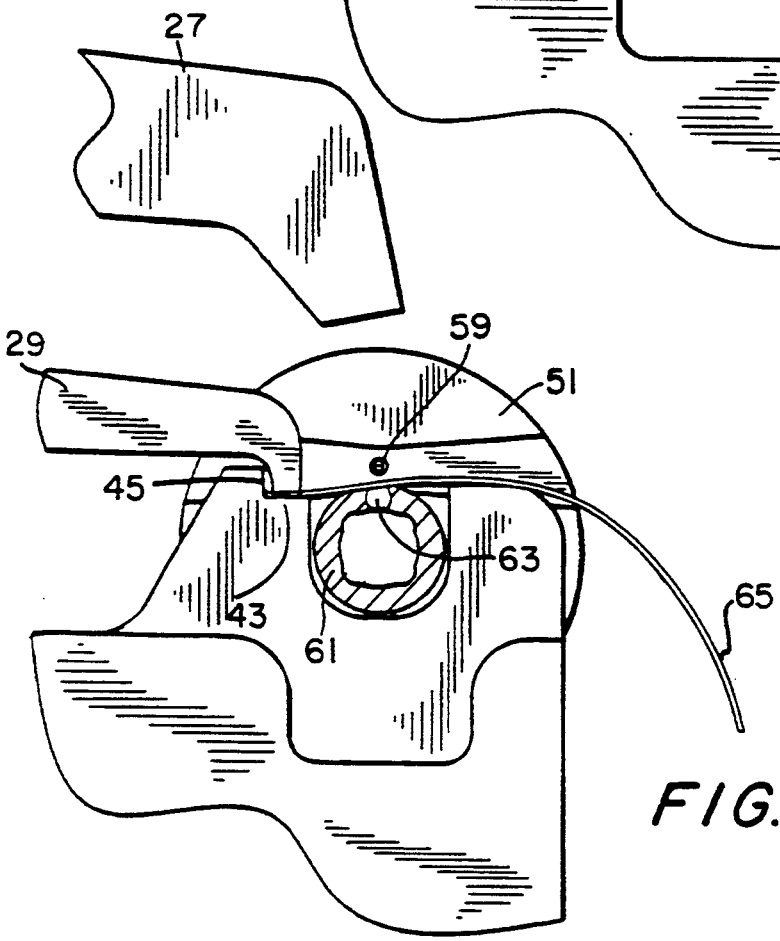
FIG. 7 is a view similar to FIG. 6 and showing the tape clamp holding the tape against the tape anvil.

In FIG. 7, operating lever 15, visible in FIGS. 1–5, but not in FIGS. 6–9, has been moved partially forward. Insertion tool 27 has begun to lower, and tape clamp 29 has moved downwardly, pressing tape 65 against tape anvil 43 in order to hold tape 65 in position during assembly.

Figure 8:
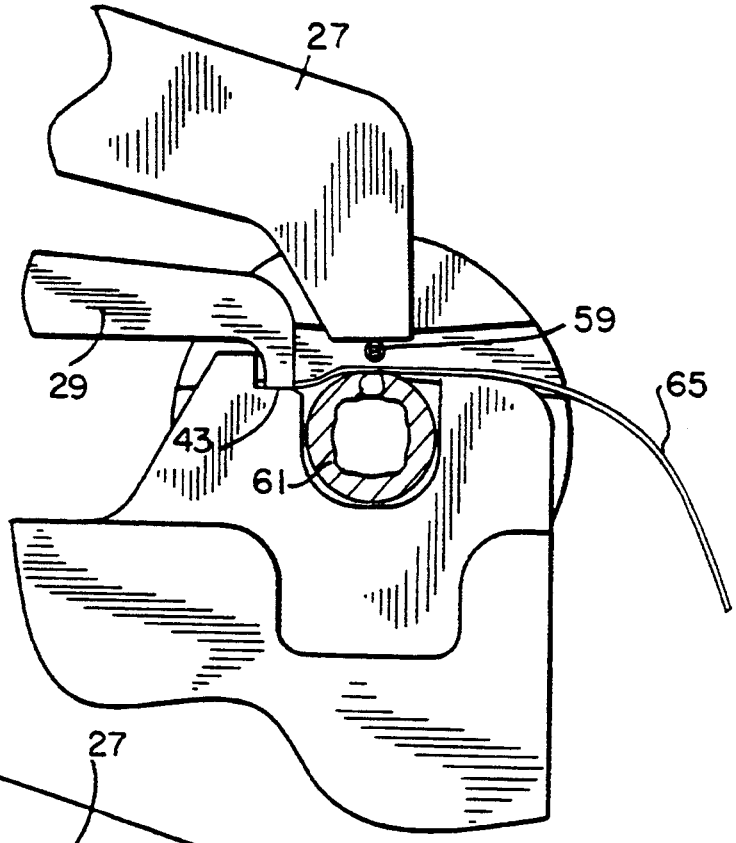
FIG. 8 is a view similar to FIGS. 6 and 7 and showing the insertion tool in operation such that it is just coming into contact with the pin of the spool.

In FIG. 8, operating lever 15 has been further advanced, bringing insertion tool 27 into contact with pin 59. Tape clamp 29 is in substantially the same position as in FIG. 7 (in contact with tape 65 and tape anvil 43). The further motion of insertion tool 27 has, however, added to the pressure exerted by compression spring 33 on tape clamp 29, holding tape 65 more firmly in place.

Figure 9:
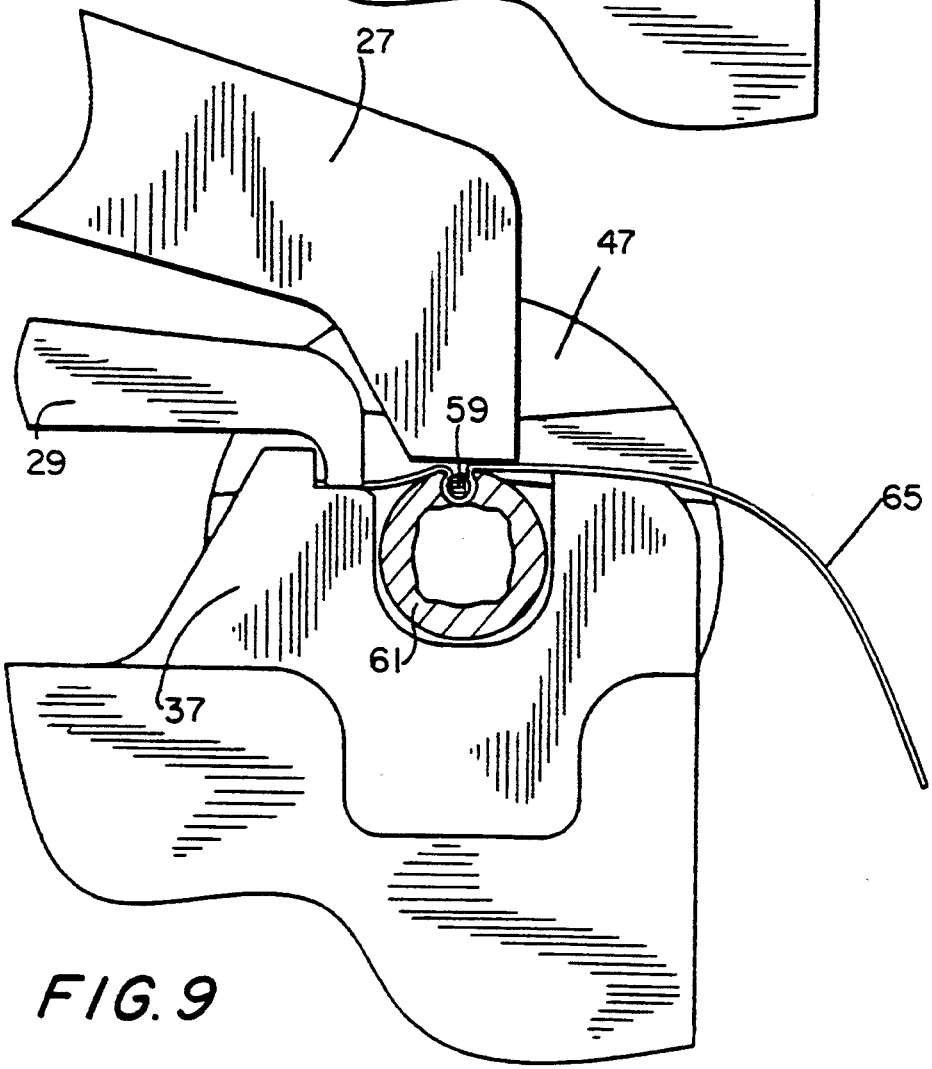
FIG. 9 is a view similar to FIGS. 6–8 and showing the insertion tool fully operated and the tape installation completed.

FIG. 9 shows the assembly completed as it would be with operating lever 15 fully rotated. Insertion tool 27 has broken pin 59 free of the spool and pressed it into pocket 63 with tape 65 wrapped about it. The reverse movement of operating lever 15 to the fully open and starting position retracts both insertion tool 27 and tape clamp 29 which allows spool 47, with tape 65 now firmly attached thereto, to be lifted off support rib 34, completing the assembly process.

The innovative assembly machine provides a means of assembly of the tape to the spool which requires no additional parts and does not use an adhesive. The assembly machine assures proper positioning and holds each of the parts in place for assembly with no special skills nor great care required of the machine operator. The assembly is quick and reliable.

It will thus be seen that the objects set forth above among those made apparent from the preceding description, are efficiently attained and, since certain changes may be made in the construction of the inventive spring clutch without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

We claim:

1. A system for enabling the assembly of a length of tape to a rotatable core of a spool prior to tape winding about said core, comprising:

a clamp member adapted for selectively pressing down on an end of said length of tape at a first location therealong away from said rotatable core;

an arm member adapted to inwardly force a retention member located substantially above said tape end toward said rotatable core in order to urge said tape and at a second location therealong toward the rotatable core; and a spring means connected between said clamp member and said arm member for urging said clamp member toward said tape end;

wherein said clamp member and said arm member operate in an integrated fashion.

2. The system of claim 1, wherein said retention member is received in a pocket formed in said core in response to said inward force by said arm member.

3. The system of claim 1, wherein said retention member is a pin.

4. The system of claim 1, further including an operating arm for selectively operating said clamp member and said arm member.

5. The system of claim 4, wherein said clamp member is adapted to press down on said tape end at said first location therealong in response to moving said operating arm from a first inoperative position to second operative position.

6. The system of claim 4, further including a link member disposed between said operating arm and said arm member and rotatably connected to each.

7. The system of claim 1, wherein said clamp member and said arm member each have a first end and a second end, said first ends being rotatably mounted together.

8. The system of claim 7, wherein said second end of said clamp member includes a surface adapted to press down on said tape end at said first location.

9. The system of claim 7, wherein said second end of said arm member includes a surface adapted to urge said retention member and tape end at said second location toward said core.

10. The system of claim 1, further including means for holding said spool with said rotatable core in a substantially fixed position.

11. The system of claim 10, wherein said holding means comprises a mounting nest.

12. The system of claim 11, wherein said spool includes a pair of substantially parallel side walls transversely disposed with respect to said core and said nest includes a supporting rib over which said side walls of said spool are adapted to mount.

13. The system of claim 12, wherein said nest further includes a cut-out in which said rotatable core of said spool is adapted to fit.

14. The system of claim 13, wherein said nest further includes a stop against which said tape end abuts when said spool is mounted in said nest and said tape end is disposed over said rotatable core and beneath said retention member.

15. The system of claim 14, wherein said nest further includes an anvil against which said clamp member presses down on said tape end at said first location.

16. A system for enabling the assembly of a length of tape to a rotatable core of a spool prior to tape winding about said core, comprising:

a clamp member adapted for selectively pressing down on an end of said length of tape at a first location therealong away from said rotatable core;

an arm member adapted to inwardly force a retention member located substantially above said tape end toward said rotatable core in order to urge said tape end at a second location therealong toward the rotatable core;

an operating arm for selectively operating said clamp member and said arm member;

a link member disposed between said operating arm and said arm member and rotatably connected to each;

wherein said clamp member and said arm member operate in an integrated fashion.

17. The system of claim 16, wherein said clamp member is adapted to press down on said tape end at a first location therealong in response to moving said operating arm from a first inoperative position to a second operative position.

18. The system of claim 17, wherein said arm member is adapted to urge said tape end at a second location therealong toward the core in response to moving said operating arm from said second position to a third operating position.

19. The system of claim 16, wherein said clamp member and said arm member each have a first end and a second end, said first end being rotatably mounted together.

20. The system of claim 19, wherein said holding means comprises a mounting nest.

21. The system of claim 16, further including means for holding said spool with said rotatable core in a substantially fixed position.

22. A system for enabling the assembly of a length of tape to a rotatable core of a spool prior to tape winding about said core comprising:

a clamp member adapted to selectively press down on an end of said length of tape at a first location therealong away from said rotatable core;

an arm member adapted to inwardly force a retention member located substantially above said tape end toward said rotatable core in order to urge said tape end at a second location therealong toward the rotatable core;

a mounting nest for holding said spool with said rotatable core in a substantially fixed position;

wherein said nest includes a stop against which said tape end abuts when said spool is mounted in said nest and said tape end is disposed over said rotatable core and beneath said retention member;

wherein said clamp member and said arm member operate in an integrated fashion.

23. The system of claim 22, wherein said spool includes a pair of substantially parallel flanges transversely disposed with respect to said core and said nest includes a supporting rib over which said flanges of said spool are adapted to mount.

24. The system of claim 22, wherein said nest further includes a cut-out in which said rotatable core of said spool is adapted to fit.

25. The system of claim 22, wherein said nest includes an anvil against which said clamp member presses down on said tape end at said first location.

26. A system for enabling the assembly of a length of tape to a rotatable core of a spool prior to tape winding about said core, comprising:

a clamp member adapted for selectively pressing down on an end of said length of tape at a first location therealong away from said rotatable core;

an arm member adapted to inwardly force a retention member located substantially above said tape end toward said rotatable core in order to urge said tape to a second location therealong toward the rotatable core; and an operating arm for selectively operating said clamp member and said arm member;

wherein said clamp member is adapted to press down on said tape end at said first location therealong in response to moving said operating arm from a first inoperative position to second operative position;

wherein said arm member is adapted to urge said tape end at said second location therealong toward the core in response to moving said operating arm from said second position to a third further operating position;

wherein said clamp member and said arm member operate in an integrated fashion.

27. A system for enabling the assembly of a length of tape to a rotatable core of a spool prior to tape winding about said core, comprising:

a clamp member adapted for selectively pressing down on an end of said length of tape at a first location therealong away from said rotatable core;

an arm member adapted to inwardly force a retention member located substantially above said tape end toward said rotatable core in order to urge said tape to a second location therealong toward the rotatable core; and wherein said clamp member and said arm member each have a first end and a second end, said first ends being rotatably mounted together;

wherein said clamp member and said arm member operate in an integrated fashion.

28. The system of claim 27, wherein said second end of said clamp member includes a surface adapted to press down on said tape end at said first location.

29. The system of claim 27, wherein said second end of said arm member includes a surface adapted to urge said retention member and tape end at said second location toward said core.

* * * * *